US010905625B2

(12) United States Patent
Terkes

(10) Patent No.: US 10,905,625 B2
(45) Date of Patent: Feb. 2, 2021

(54) MASSAGE TOY WITH INTEGRATED MOVEABLE BALLS

(71) Applicant: Fun Factory GmbH, Bremen (DE)

(72) Inventor: Servet Terkes, Bremen (DE)

(73) Assignee: Fun Factory GmbH, Bremen (DE)

( * ) Notice: Subject to any disclaimer, the term of this patent is extended or adjusted under 35 U.S.C. 154(b) by 620 days.

(21) Appl. No.: 15/517,945

(22) PCT Filed: Oct. 8, 2015

(86) PCT No.: PCT/EP2015/073300
§ 371 (c)(1),
(2) Date: Apr. 7, 2017

(87) PCT Pub. No.: WO2016/055588
PCT Pub. Date: Apr. 14, 2016

(65) Prior Publication Data

US 2017/0304143 A1 Oct. 26, 2017

(30) Foreign Application Priority Data

Oct. 8, 2014 (DE) ..... 20 2014 008 093 U
Dec. 18, 2014 (DE) ..... 20 2014 010 029 U

(51) Int. Cl.
*A61H 19/00* (2006.01)
*A61H 21/00* (2006.01)
(Continued)

(52) U.S. Cl.
CPC ..... *A61H 19/44* (2013.01); *A61H 21/00* (2013.01); *A61H 23/00* (2013.01);
(Continued)

(58) Field of Classification Search
CPC ..... A61H 19/40; A61H 19/44; A61H 19/30; A61H 19/32; A61H 23/00; A61H 2015/0064; A61H 2015/0071; A61H 21/00
(Continued)

(56) References Cited

U.S. PATENT DOCUMENTS 5,573,499 A 11/1996 McAllister
9,192,542 B2 * 11/2015 Blenk ..... A61H 23/02
(Continued)

FOREIGN PATENT DOCUMENTS

DE 296 05 288 U1 6/1996
DE 29505288 U1 6/1996
(Continued)

OTHER PUBLICATIONS

Amazon.com_ LELO Luna Beads (Regular Size) https://www.amazon.com/LELO-LUNA-Beads-Regular-Size/dp/B0029ZALB2 (Year: 2004).*
(Continued)

*Primary Examiner* — Samchuan C Yao
*Assistant Examiner* — Cana A Gallegos
(74) *Attorney, Agent, or Firm* — Seed IP Law Group LLP

(57) ABSTRACT

A massage toy, in particular a dildo or vibrator, includes a substantially cylindrical base member which is made of a supple material. The base member has at least one inner cavity in which a freely movable inertial member is arranged. A method of producing a massage toy with a substantially cylindrical base member, at least one inner cavity, and a movable inertial member is also described.

22 Claims, 3 Drawing Sheets

(51) Int. Cl.
*A61H 23/00* (2006.01)
*A61H 15/00* (2006.01)

(52) U.S. Cl.
CPC ..... *A61H 2015/0064* (2013.01); *A61H 2015/0071* (2013.01); *A61H 2023/002* (2013.01); *A61H 2201/0107* (2013.01)

(58) Field of Classification Search
USPC ..... 601/41
See application file for complete search history.

(56) References Cited

U.S. PATENT DOCUMENTS

2002/0099262 A1* 7/2002 Knoll-Ewers ..... A61H 19/44 600/40
2002/0103415 A1* 8/2002 Manska ..... A61H 19/44 600/38
2005/0130818 A1* 6/2005 Karol ..... A63B 23/20 482/148
2007/0179523 A1* 8/2007 Jing ..... A61H 39/04 606/204
2010/0041944 A1 2/2010 Levy
2014/0024980 A1* 1/2014 Ortiz ..... A61H 19/34 601/46
2015/0174001 A1* 6/2015 Milton ..... A61H 21/00 600/41

FOREIGN PATENT DOCUMENTS

DE 10 2008 055 869 A1 7/2010
DE 202009010633 U1 * 12/2010 ..... A61H 21/00
DE 202009010633 U1 12/2010
GB 2530490 A * 3/2016 ..... A63B 23/20

OTHER PUBLICATIONS

International Preliminary Report on Patentability, dated Apr. 11, 2017, for International Application No. PCT/EP2015/073300, 13 pages (with English Translation).
International Search Report from PCT/EP2015/073300, dated Apr. 12, 2015, 2 pages.

* cited by examiner

MASSAGE TOY WITH INTEGRATED MOVEABLE BALLS

BACKGROUND

The invention relates to a massage toy, in particular a dildo or vibrator or the like, comprising a substantially cylindrical base member which is made of a supple material. The invention further relates to the use of a love ball, in particular a Smartball® (Smartballs® is a registered trademark of the applicant), and to a method of producing a massage toy.

BRIEF SUMMARY

Massage toys of the kind initially specified are known in many variants from the prior art. A basic distinction is made between passive and active toys, passive toys generally being called dildos, and active toys, in particular motor-driven toys, being called vibrators. Vibrators generally have a battery or a rechargeable battery and a motor which drives an unbalanced mass so that a base member of the toy, or a portion of it, is made to vibrate and can thus be used for stimulation or massage. One disadvantage in this regard is the limited capacity of the battery or rechargeable battery.

Dildos, in contrast, are generally passive and do not have an electrical drive. They mostly have a cylindrical base member which substantially imitates the shape of the erect male sex organ in many cases. Many also have a broader section or grip portion with which the dildo can be handled, the broader section also serving to limit the depth of penetration into a body orifice. Dildos for female couples are also known, which mostly have two opposite cylindrical base members arranged coaxially with or at an angle to each other. The present invention relates to the species of passive, non-driven dildos.

Although many different dildos are already known on the market, there is still a need to specify dildos having improved characteristics regarding their suitability for massage, for stimulation, in particular for stimulation of female sex organs, in particular without an electrical drive.

It is therefore an object of the present invention to specify massage toys of the kind initially specified, and a use of love balls and a method of producing same, which are improved in respect of the aforementioned characteristics.

This object is achieved, in the case of the massage toy initially specified, by the base member having at least one inner cavity in which a freely movable inertial member is arranged.

The inertial member can move inside the cavity. The movement of the inertial member inside the cavity causes the supple base member to move and/or vibrate, with improved stimulation being the result. Due to the inertia of the inertial member, it may collide against an inner wall of the cavity when moved accordingly, and when it comes into contact with the wall it transfers impact energy to the base member, which is made to vibrate as a result. The inertial member may also roll or slide along the wall of the cavity, thus exerting a centrifugal force on the base member when the toy is moved accordingly. The centre of gravity of the base member also moves due to the inertial member moving inside the cavity, which likewise results in substantially improved stimulation. The invention makes it possible to improve stimulation substantially provided by a dildo, without requiring a motor-driven mass as in conventional vibrators. Simply moving the dildo manually causes the inertial member to move and to transfer energy to the base member.

The base member is substantially cylindrical and is preferably shaped approximately like an erect male sex organ. Substantially cylindrical relates here to the basic shape of the base member and also includes slightly undulating external contours and slightly curved shapes. The base member itself is preferably formed completely from a supple material which is preferably medical grade and skin-friendly.

The inertial member is preferably rigid. The inertial member is able to move inside the cavity, shift the centre of gravity and transfer energy (impact energy, for example) to the base member. A rigid inertial member, in particular, is suitable for that purpose. The inertial member is preferably of such rigidity that it itself absorbs as little of the impact energy as possible when colliding with an inner wall of the cavity, but transfers that energy as fully as possible to the base member. Stimulation is particularly good as a result. For less intensive stimulation, it may also be preferred to use a fluid instead of the inertial member, the volume of said fluid being less than the interior volume of the cavity, in particular 50% or less thereof.

According to a first preferred embodiment of the invention, the base member has at least one inner cavity. In another preferred embodiment, it has, two, three, or more inner cavities, in each of which a freely movable inertial member is arranged. In a preferred embodiment, the number of distinct inner cavities is set at three. Stimulation is further improved as a result. Three cavities can be advantageously provided when the base member has a preferred axial length ranging from approximately 17 cm to 22 cm. It is thus possible and preferable to provide a total of six cavities in dildos which have two opposite base members and which are intended for female couples. The cavities may all be formed identically, or they may differ from one another. For example, it may be preferable to make one cavity at the front axial end of the base member larger than at the rear axial end. The converse configuration is also conceivable and, depending on actual usage, may also be preferred.

According to another preferred embodiment, the inertial member is round. It is particularly preferable that the inertial member is spherical in shape. A round shape, in particular a spherical shape, is a particularly simple shape that provides advantages for the production process, and such an inertial member can roll inside the cavity and thus, when the toy is moved accordingly, can also act as an unbalanced mass and also transfer impact energy.

It is particularly preferred that the inner cavity has an inner profile having a larger diameter than the inertial member, so that the inertial member can move freely inside the cavity. The cavity preferably has an inner diameter that is larger everywhere than the largest diameter of the inertial member. This allows the inertial member to move particularly freely inside the cavity without any jamming or the like.

In one preferred development of the invention, the diameter of the cavity exceeds the diameter of the inertial member by an amount ranging from 2 mm to 20 mm, preferably 3 mm to 15 mm, particularly preferably from 4 mm to 10 mm, and even more preferably from approximately 6 mm to 10 mm.

It is further preferred that the diameter of the cavity exceeds the diameter of the inertial member by an amount ranging from 10% to 100%, preferably 10% to 50%, more particularly from 10% to 70%, preferably 20% to 60%, and particularly preferably from 15% to 30% or from 30% to 50%. With such values and ratios, a certain amount of clearance is provided between the inertial member and an inner wall of the cavity, which is sufficient to transfer not only a preferred impact energy, by providing a sufficiently long path for accelerating the inertial member, but also to transfer a vibration due to the inertial member rolling inside the cavity and shifting the centre of gravity of the base member.

According to a preferred development of the invention, the inertial member has a volume V1 and the cavity has an inner volume V2, and a ratio of volume V1 to V2 in a range from 0.1 to 1.0, preferably from 0.1 to 0.6, and particularly preferably from 0.2 to 0.5. In that case also, a certain amount of clearance is provided between the inertial member and an inner wall of the cavity, which is sufficient to transfer not only a preferred impact energy, by providing a sufficiently long path for accelerating the inertial member, but also to transfer a vibration due to the inertial member rolling inside the cavity and shifting the centre of gravity of the base member.

It is preferable that the inertial member has a mass m1, that the toy has a mass m2, and that the ratio of mass m1 to m2 is in a range from 0.01 to 1, preferably from 0.01 to 0.5, particularly preferably from 0.1 to 0.3 and most preferably approximately 0.2. Such a ratio of the masses produces an intrinsically dynamic effect, and the toy moves because of a transmission of impulses from the inertial member to the body of the toy. When there is a plurality of cavities with a respective plurality of inertial members, mass m1 pertains to the total masses of all the inertial members.

In another preferred embodiment, the cavity has an inner profile which is substantially spherical. In yet another preferred embodiment, the cavity has an inner profile which is substantially ellipsoidal. Both profiles, spherical and ellipsoidal, are particularly preferred when the inertial member likewise has a round shape, for example a spherical or ellipsoidal shape. In this way, the inner profile of the cavity matches an external profile of the inertial member, and the inertial member can roll inside the cavity and thus transfer impact energy, or energy due to centrifugal forces, to the base member and shift the centre of gravity of the base member. Matching profiles also have the advantage that less noise is produced, which is likewise preferred. It is desirable that such a toy does not produce any rattling or clicking noises when in use, but can be operated with as little noise as possible.

According to another preferred embodiment of the invention, the cavity has a principal axis, and the principal axis extends substantially coaxially with a central axis of the base member. According to this embodiment, it is preferable that the cavity is substantially ellipsoidal. A path travelled by the inertial member in the direction of the central axis of the base member is greater as a result than a path of radial movement relative to the base member, thus providing a further improvement in stimulation with the toy. Any shift of the centre of gravity along the central axis is greater than any shift in the radial direction relative to the base member, and any transfer of impact energy in the former direction is also greater. This corresponds more closely to a natural movement, thus resulting in improved stimulation.

A particularly preferred embodiment is one in which at least one rigid enclosure is arranged in and completely enclosed by the base member, and in which said enclosure defines the cavity. The enclosure thus encloses a hollow space which forms the cavity, and an inner surface of the enclosure defines the profile of the cavity. Since the base member is made of a supple material, providing a rigid enclosure around the inertial member allows energy to be transferred particularly well from the inertial member to the base member. The energy, for example impact energy, is not absorbed straight away by the material of the base member, but is initially transferred to the rigid enclosure, which then transfers the energy along its entire outer surface, which is entirely surrounded by the base member.

It is further preferred that the enclosure is formed of two half-shells. This is a particularly simple way of forming the rigid enclosure and reduces costs when assembling and producing the toy. The enclosure can thus be produced as an injection-moulded part, for example, and can enclose the inertial member by joining the two half-shells of the enclosure.

According to another preferred embodiment, ribs are formed at an inner wall enclosing the cavity. The ribs preferably protrude in the direction of the cavity, and in such a case the end portions of the ribs facing inwards define an enveloping surface which defines the profile of the cavity. A contact surface between the inertial member and the wall or enveloping surface of the cavity is reduced by the ribs, which also reduces any noise produced when handling the toy. If, as in any of the embodiments described in the foregoing, an enclosure which defines the cavity is provided in the base member, the ribs are preferably moulded integrally on the enclosure.

According to one particularly preferred embodiment of the invention, at least one love ball, preferably a Smartball®, is arranged in the base member, and the enclosure of the love ball defines the cavity and the inner ball of the love ball forms the inertial member. The love ball is preferably a Smartball®, so called, such as the one developed, produced and sold by the present applicant, in particular under article numbers EAN 4032498331652 and EAN 4032498333083. Such love balls or Smartballs® or B-Balls are provided to strengthen and invigorate the muscles of the pelvic floor and have a movable ball inside that stimulates the pelvic floor muscles and trains them. Such Smartballs® are particularly suitable for integration in the base member of the toy and result in a toy with which a particularly preferred form of stimulation can be achieved.

In another preferred embodiment, the base member is made of a silicone, preferably of a medical grade silicone. Silicone is particularly suitable because it is pleasantly soft, thus producing particularly pleasurable stimulation when using the toy. Above all, the base member is very hugging due to its elastic surface structure, which allows its outer profile to adjust to body parts massaged or stimulated by means of the toy.

In another preferred embodiment, the base member is slightly widened radially externally in the region of the cavity. If a plurality of cavities are provided, the base member is preferably slightly widened in the region of every cavity. This gives the base member a slightly undulating external structure. Slight constrictions on the member are thus provided between the cavities. The undulating structure improves the stimulating capabilities of the toy. The thickness of the base member wall around the cavity is preferably in a range between 2 mm and 15 mm, preferably between 3 mm and 10 mm. Energy can be transferred particularly well as a result from the inertial member and from the enclosure to the base member and outwards. If an enclosure is provided around the cavity, the aforementioned values relate to a wall thickness of the base member around the enclosure.

According to another aspect of the invention, the object referred to at the outset is achieved by using a love ball. While any love ball is accepted, the use of a Smartball®, which is a particular type of love ball, is preferred. The love ball (or Smartball®) is used for integration in a base member of a dildo. This provides the advantages described in the foregoing, so reference is made in full to the description above.

According to another aspect of the invention, the object referred to at the outset is achieved by a method of producing a massage toy, in particular according to any one of the preferred embodiments of a massage toy as described in the foregoing, by casting at least one love ball, in particular Smartballs®, in a silicone material to form a base member. This is done by arranging the love ball, in particular a Smartball®, in a casting mould and filling the casting mould with silicone in such a way that the love ball, in particular a Smartball®, is completely enclosed by the silicone material. One, two, three or more love balls are preferably provided. For the other preferred variants of the massage toy produced in this manner, reference is made to the preferred embodiments of a massage toy as described above, and in this regard to the description above.

The invention can also be constructed in the form of a vibrator. In this case a motor-driven source of vibration or motion is provided, in which the source of vibration or motion ensures that the inertial member inside the cavity is excited, that is to say is moved. This can be done by having a recess or open cavity in the base end in which a vibrating member can be inserted, or by casting a vibration capable motor in the base. Such a vibrator will also have an appropriate source of energy, for example a battery.

BRIEF DESCRIPTION OF THE SEVERAL VIEWS OF THE DRAWINGS

The invention shall now be described in more detail with reference to an embodiment and with reference to the attached drawings, in which.

DETAILED DESCRIPTION

Figure 1:
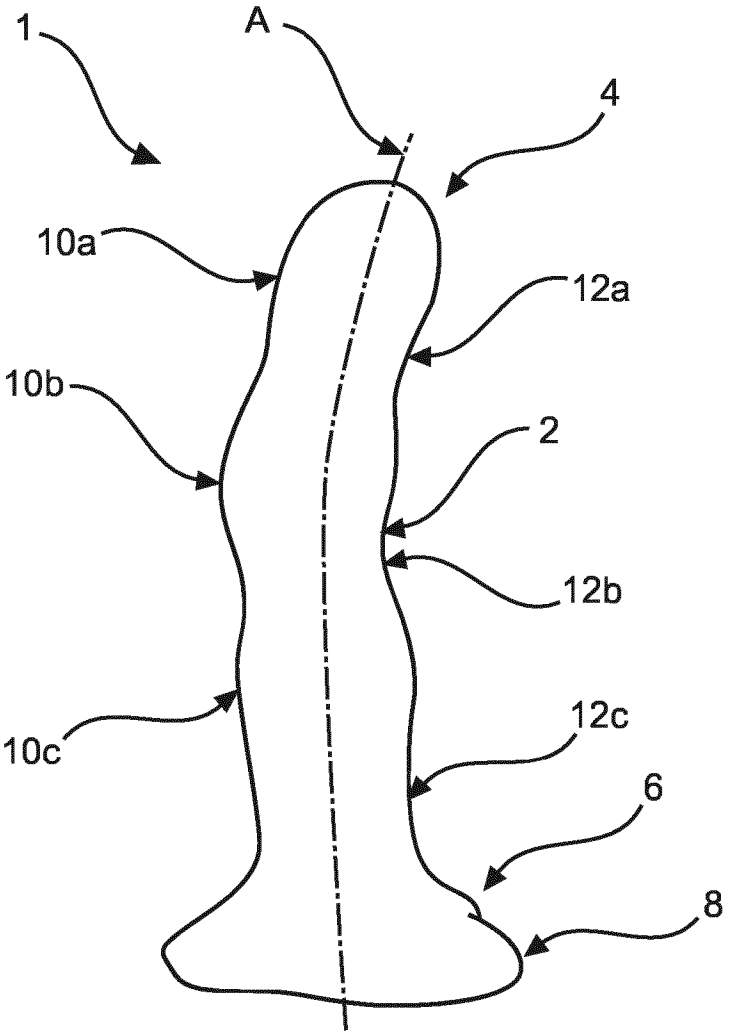
FIG. 1 shows a side elevation view of a massage toy.

According to FIG. 1, a massage toy 1 has a base member 2. Base member 2 is substantially cylindrical and has a central axis A that is slightly curved in this embodiment. Base member 2 is made of a supple, medical-grade silicone material and is therefore elastic as a whole, so it can also be straightened up in such a way that central axis A is straight. Base member 2 also has a front axial end 4 and a rear axial end 6. At the rear axial end 6, a flange-like radial extension 8 is provided which serves to limit the axial depth of penetration of base member 2 from the front axial end 4 to the rear axial end 6. The flange-like radial extension 8 also serves as a grip or harness for handling toy 1.

Figure 2:
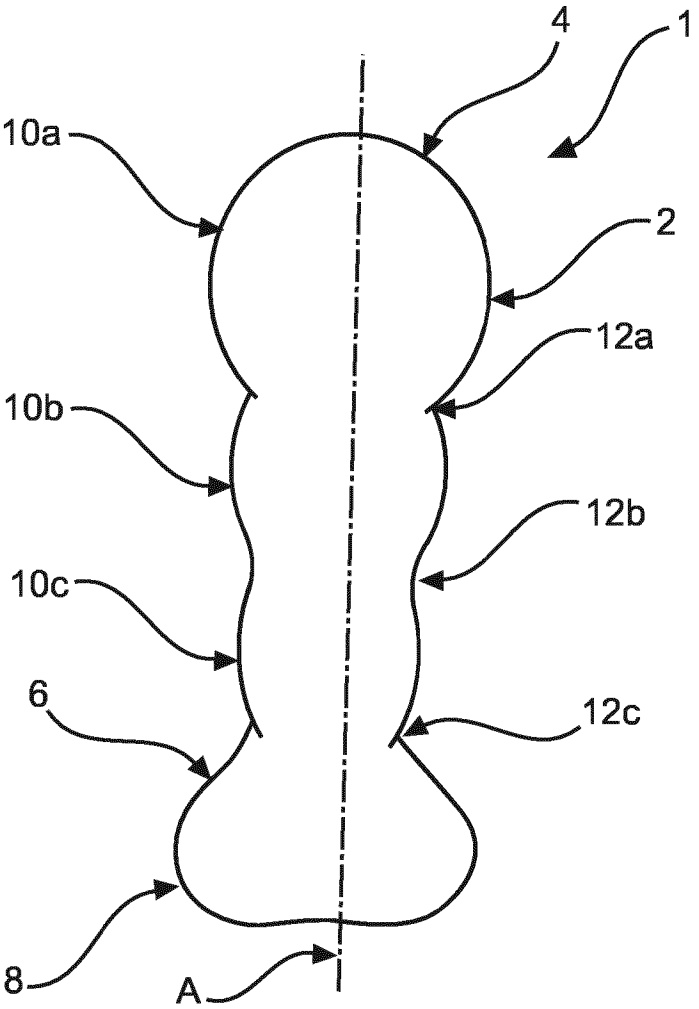
FIG. 2 shows a perspective front view of the massage toy shown in FIG. 1.

In this embodiment of the invention, base member 2 has three cavities 22 (see FIGS. 3 and 4), so three radial bulges 10*a*, 10*b*, 10*c* and three radial constrictions 12*a*, 12*b*, 12*c* corresponding to radial bulges 10*a*, 10*b*, 10*c* can be seen on base member 2, with the result that base member 2 has a slightly undulating shape on the whole. This configuration can also be seen in the perspective view shown in FIG. 2.

Figure 3:
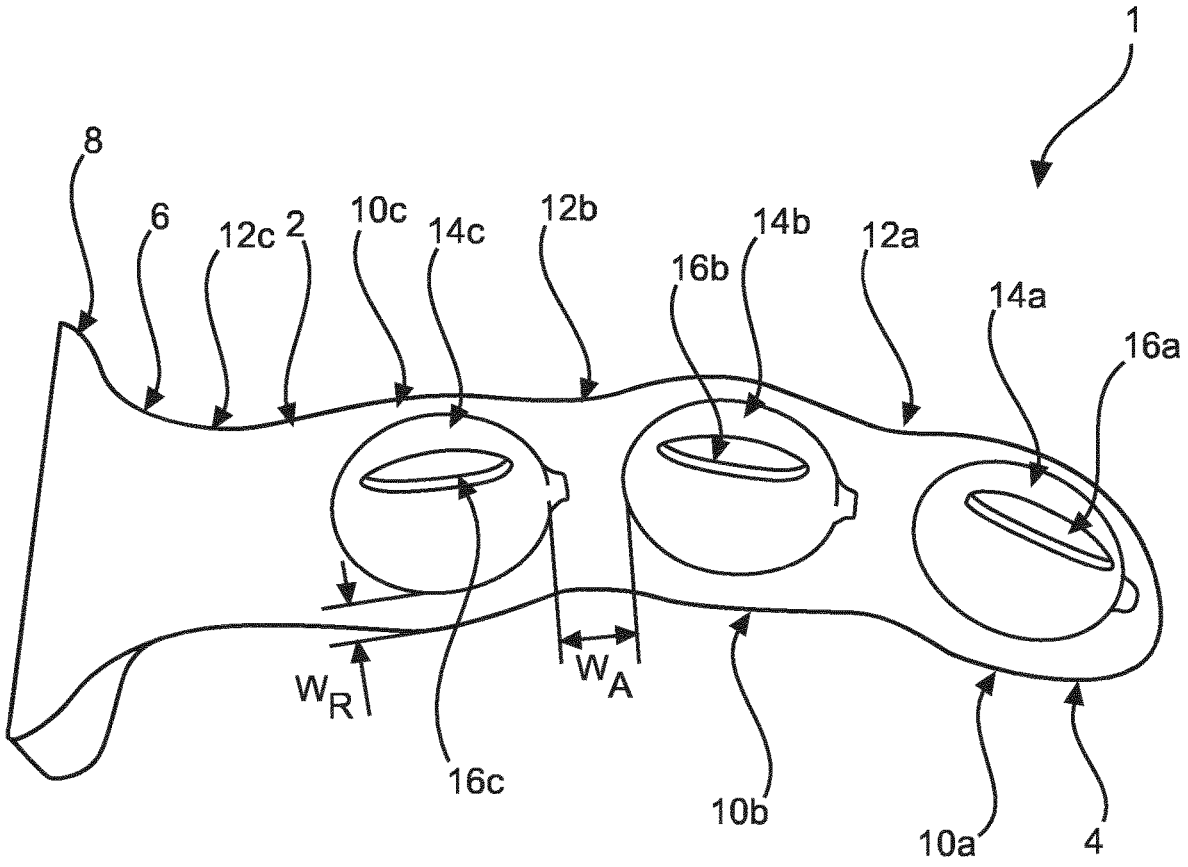
FIG. 3 shows a partial cutaway view of the massage toy, showing three cavities enclosed by enclosures.

FIG. 3 shows a partial cutaway view through toy 1 along axis A. The cut is only partial, because cavities 22 themselves as well as inertial member 24 are not visible (see FIG. 4 in that regard). In this embodiment, cavities 22 are defined by enclosures 14*a*, 14*b*, 14*c*, which are not cut through in FIG. 3. In this embodiment, three enclosures 14*a*, 14*b*, 14*c* are provided, inside each of which an inertial member 24 (cf. FIG. 4) is arranged. In combination with inertial members 24 arranged therein, enclosures 14*a*, 14*b*, 14*c* form a Smartball®, of the kind developed, produced and sold by the present applicant. Smartball® is a commercial product that has been sold on the open market for a few years, and thus is well known in the art and need not be described further. In the embodiment shown in FIG. 3, three Smartballs® are provided accordingly in base member 2. In one version, each Smartball® is fully isolated from the others. In other versions, a small cord can connect adjacent Smartballs® to each other.

The ratio of the total mass of all three inertial members 24 to the total mass of toy 1 is 0.07 to 1.0 in this embodiment. As can be seen from FIG. 3, radial bulges 10*a*, 10*b*, 10*c* are provided in the regions in which enclosures 14*a*, 14*b*, 14*c* are arranged in base member 2. Enclosures 14*a*, 14*b*, 14*c* have a substantially ellipsoidal or egg-shaped external profile and are spaced apart from each other by a gap WA. Enclosures 14*a*, 14*b*, 14*c* are not interconnected, even if that may be provided in other embodiments. In this embodiment, one enclosure 14*a* is provided in the region of base member 2 that forms the glands of the male sexual organ, and two enclosures 14*b*, 14*c* are provided in the region of base member 2 which constitutes the shaft in a male sex organ. The gap WA between two adjacent enclosures 14*b*, 14*c* and 14*a*, 14*b* is chosen so that sufficient material is present there to allow flexion of base member 2. A slight constriction is additionally provided on the base member in regions 12*a*, 12*b*, 12*c*. This results in a preferred external profile, as already described above with reference to FIGS. 1 and 2.

Each enclosure 14*a*, 14*b*, 14*c* is surrounded radially externally by a wall of base member 2 that is WR thick (marked only for enclosure 14*c*). Wall thickness WR is selected to allow energy transfer from enclosure 14*a*, 14*b*, 14*c* to base member 2 and outwardly from the latter, and so that absorption by the silicone material of base member 2 is not too great. Due to enclosures 14*a*, 14*b*, 14*c* being rigid and preferably made of a non-elastic plastic, base member 2 acquires a certain degree of stability and resistance to pressure, which is preferable for stimulation.

A rib 16*a*, 16*b*, 16*c* which serves to produce an improved connection between the silicone material of base member 2 and enclosure 14*a*, 14*b*, 14*c* is provided on a radially external surface of enclosure 14*a*, 14*b*, 14*c*.

Figure 4:
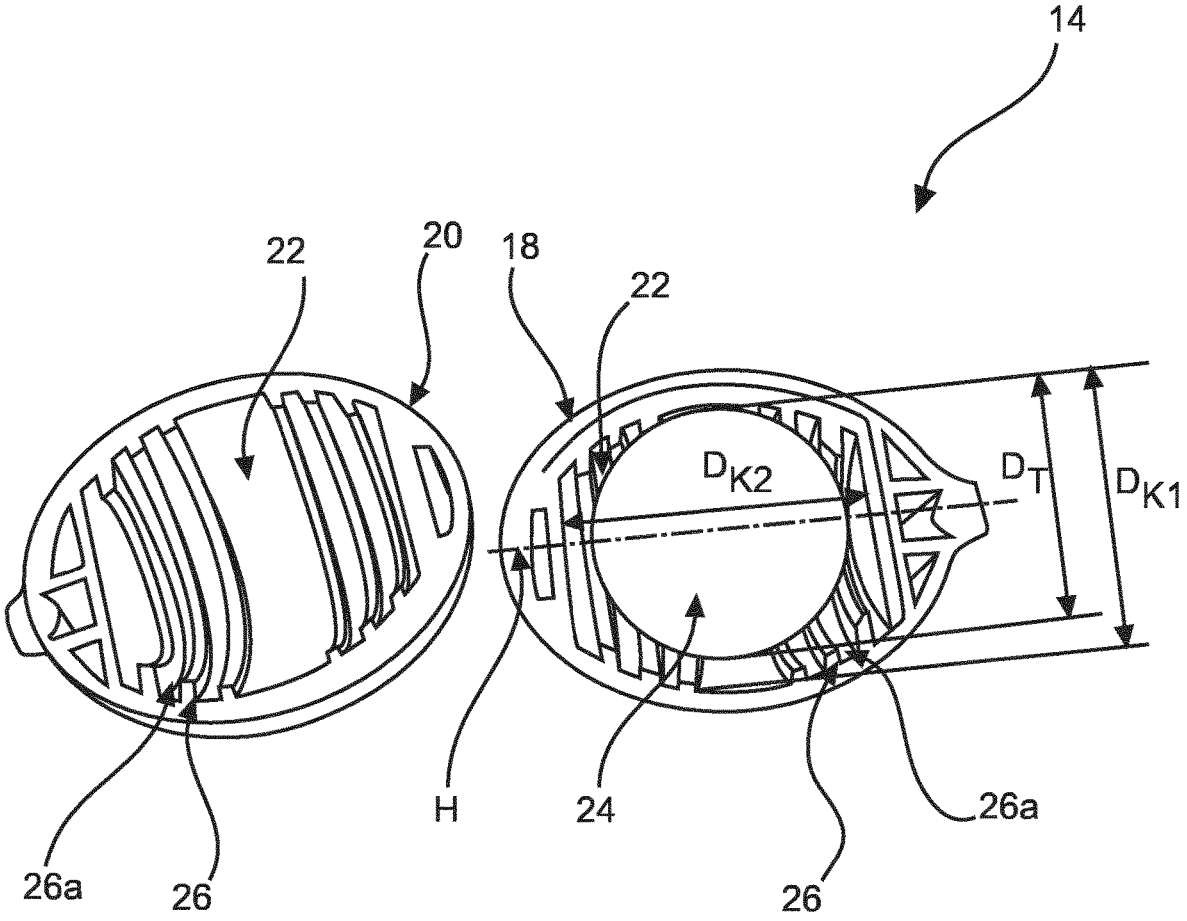
FIG. 4 shows an opened enclosure containing an inertial member.

Each enclosure 14 has a cavity 22 on the inside. Cavity 22 and inertial member 24 can be seen in more detail in FIG. 4. FIG. 4 also shows an opened enclosure 14, with the two half-shells 18, 20 forming enclosure 14 being dissembled. The interior of enclosure 14 defines a cavity 22 in which an inertial member 24 is arranged. In each of its half-shells 18, 20, enclosure 14 has inwardly protruding ribs 26 extending circumferentially about a main axis A (only one rib in each is marked with a reference sign), and the radially inwardly protruding end portions 26*a* of ribs 26 jointly define an enveloping profile that forms the profile of cavity 22.

In this embodiment, inertial member 24 is in the form of a ball, in particular in the form of a ball made of a metal material, a hard plastic material, a ceramic material or a wooden material, preferably a material with a relatively high density, and preferably with a higher density than the density of base member 2.

Cavity 22 has a basic shape that is substantially ellipsoidal, with a principal axis H. When the enclosure is integrated (cf. FIG. 3), said principal axis H is oriented in such a way that it extends substantially coaxially with axis A of the base member.

As can also be seen from FIG. 4, inertial member 24 is significantly smaller than cavity 22 and therefore has a smaller diameter than the latter. Diameter DT of inertial member 24 is smaller than the radial diameter DK1 of cavity 22 and smaller than the diameter DK2 of cavity 22 measured along principal axis H. More specifically, diameter DK1 is approximately 30% larger than diameter DT, and in this embodiment DK2 is approximately 45% larger than diameter DT. Here, diameter DK1 is approximately 30.5 mm, while diameter DK2 is approximately 26.4 mm. The outer diameter of enclosure 14 (in the region of the secondary axis of the ellipse) is approximately 30 mm to 34 mm. This allows inertial member 24 to roll along end portions 26*a* of the ribs inside cavity 22 and to push against them, thus having different effects on base member 2. Inertial member 24 can collide with enclosure 14 if there is any jolting movement, thus transmitting impact energy to base member 2, and if there is rotating or circular movement of base member 2, inertial member 24 can roll on ribs 26 inside enclosure 14, thus transferring a centrifugal force onto the enclosure, as a result of which a vibration is transferred to base member 2. By simple displacement of inertial member 24 inside enclosure 14, it is also possible to continuously alter the center of gravity of base member 2. A particularly pleasant massage or stimulation is produced by all three types of movement when toy 1 is used for massage or stimulation.

In this embodiment, the weight of enclosure 14, including inertial member 24, is in a range between 29 grams and 35 grams, the weight of the inertial member being approximately 20 grams.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A massage toy, comprising:

a base member which is made of a supple material having a main portion coupled to a rear end portion, wherein the main portion has a first inner cavity and a second inner cavity with the first and second inner cavities corresponding to locations of radial bulges in the main portion with radial constrictions between the radial bulges, the first inner cavity being isolated from the second inner cavity by a portion of material of the base member, and wherein the rear end portion is radially enlarged relative to the main portion;

a first freely movable inertial member positioned in the first inner cavity; and a second freely movable inertial member positioned in the second cavity.

2. The massage toy according to claim 1, wherein at least one of the first and second inner cavities has an inner profile having a diameter that is greater than a diameter of a respective one of the first and second inertial members, so that the respective one of the first and second inertial members can move freely inside the at least one of the first and second inner cavities, and wherein the diameter of the at least one of the first and second inner cavities exceeds the diameter of the respective one of the first and second inertial members by an amount ranging from 2 mm to 20 mm.

3. The massage toy according to claim 1, wherein a diameter of at least one of the first and second inner cavities exceeds a diameter of a respective one of the first and second inertial members by an amount ranging from 10% to 100%.

4. The massage toy according to claim 1, wherein at least one of the first and second inertial members has a volume V1 and a respective one of the first and second inner cavities has an inner volume V2, and a ratio of volume V1 to V2 is in a range from 0.1 to 0.6.

5. The massage toy according to claim 1, wherein the first and second inertial members have a total mass m1 and the toy has a mass m2, and a ratio of mass m1 to m2 is in a range from 0.01 to 0.5.

6. The massage toy according to claim 1, wherein at least one of the first and second inner cavities has an inner profile which is substantially spherical or substantially ellipsoidal.

7. The massage toy according to claim 1, wherein at least one of the first and second inertial members is round or substantially spherical.

8. The massage toy according to claim 1, wherein each of the first and second inner cavities has a principal axis and the base member has a central axis, the principal axis of each of the first and second inner cavities being substantially coaxial with the central axis of the base member.

9. The massage toy according to claim 1, further comprising:

at least one rigid enclosure positioned in and completely enclosed by the base member, wherein the at least one rigid enclosure defines a corresponding at least one of the first and second inner cavities.

10. The massage toy according to claim 9, wherein the at least one rigid enclosure includes two half-shells coupled together.

11. The massage toy according to claim 1, further comprising:

a plurality of ribs extending from an inner wall enclosing at least one of the first and second inner cavities.

12. The massage toy according to claim 1, wherein the rear end portion includes a flat outermost face.

13. The massage toy according to claim 1, wherein the rear end portion flares out from a distal end of the rear end portion, which is connected to a proximal end of the substantially cylindrical portion, to a proximal end of the rear end portion.

14. A massage toy comprising:

a non-electric assembly including:

a continuous body made of a supple material having a completely closed surface and including an elongated portion;

a first enclosure positioned within the elongated portion of the body and fully surrounded by the elongated portion of the body;

a second enclosure positioned within the elongated portion of the body, and fully surrounded by the elongated portion of the body;

a first cavity internal to the first enclosure;

a first freely movable inertial member positioned inside the first cavity;

a second cavity internal to the second enclosure; and a second freely movable inertial member positioned inside the second cavity, wherein the elongated portion of the body has an undulating shape with a location of the first enclosure and a location of the second enclosure corresponding to locations of radial bulges in the elongated portion of the body; and wherein the first enclosure is isolated from the second enclosure by a portion of the supple material of the elongated portion of the body.

15. The massage toy according to claim 14, wherein the enclosure has an outer wall and further includes a rib that extends outward from the outer wall of the enclosure to provide a ridge on the outmost wall of the enclosure.

16. A device, comprising:

a massage toy, including:

a base member which is made of a supple material;

a first cavity within the base member;

a second cavity within the base member and spaced from the first cavity along the base member, wherein the first cavity and the second cavity are isolated from each other by a portion of material of the base member, wherein the portion of material of the base member between the first cavity and the second cavity is configured to flex;

a first inertial member in the first cavity; and a second inertial member in the second cavity, wherein the first and second inertial members have a total mass m1 and the massage toy has a mass m2, and a ratio of mass m1 to m2 is in a range from 0.01 to 0.5.

17. The massage toy of claim 16 wherein the base member defines a main axis, the massage toy further comprising:

a first enclosure in the first cavity, the first inertial member being in the first enclosure and the first enclosure having a first principal axis; and a second enclosure in the second cavity, the second inertial member being in the second enclosure and the second enclosure having a second principal axis, wherein the first principal axis of the first enclosure and the second principal axis of the second enclosure are each offset from the main axis of the base member.

18. A massage toy, comprising:

a base member which is made of a supple material;

a first enclosure within the base member;

a second enclosure within the base member, the first enclosure and the second enclosure corresponding to locations of radial bulges or radial in the base member;

a first cavity internal to the first enclosure;

a first freely movable inertial member positioned inside the first cavity;

a second cavity internal to the second enclosure; and a second freely movable inertial member positioned inside the second cavity, and wherein the first enclosure is isolated from the second enclosure by a portion of the material of the base member.

19. The massage toy of claim 18, further comprising:

a cavity positioned inside the first enclosure; and a freely movable inertial member positioned inside the cavity, wherein the first enclosure has a first weight and the freely movable inertial member has a second weight, a ratio of the second weight to the first weight being between 0.45 to 0.75.

20. The massage toy of claim 18 wherein the base member has a sidewall surrounding the first enclosure, the sidewall having a thickness proximate the first enclosure that is between 2 mm and 15 mm.

21. The massage toy of claim 18 wherein the first enclosure includes a first half shell with a first protrusion and a second half shell with a second protrusion, the first half shell coupled to the second half shell with the first protrusion aligned with the second protrusion.

22. A massage toy, comprising:

a continuous body including an elongated cylindrical portion having an outer surface with undulating contours;

a plurality of individual enclosures positioned within and fully surrounded by the elongated cylindrical portion and spaced from each other along the elongated cylindrical portion, wherein each of the plurality of enclosures includes:

an exterior surface in contact with the elongated cylindrical portion;

an internal cavity;

and at least one protrusion extending from the exterior surface into the elongated cylindrical portion;

and a plurality of inertial members, wherein each of the plurality of inertial members is positioned in the internal cavity of a corresponding one of the plurality of individual enclosures.

* * * * *